US009033723B2

(12) United States Patent
Jeong et al.

(10) Patent No.: US 9,033,723 B2
(45) Date of Patent: May 19, 2015

(54) HIGH VOLTAGE CONNECTOR

(71) Applicants: Jin Su Jeong, Gyeonggi-do (KR); Hyong Joon Park, Gyeonggi-do (KR)

(72) Inventors: Jin Su Jeong, Gyeonggi-do (KR); Hyong Joon Park, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/095,578

(22) Filed: Dec. 3, 2013

(65) Prior Publication Data

US 2015/0011109 A1 Jan. 8, 2015

(30) Foreign Application Priority Data

Jul. 5, 2013 (KR) ..... 10-2013-0078868

(51) Int. Cl.
*H01R 13/62* (2006.01)

(52) U.S. Cl.
CPC ..... *H01R 13/62* (2013.01)

(58) Field of Classification Search
CPC ..... H01R 13/629; H01R 13/6275; H01R 13/6397; H01R 13/6633; H01R 23/66; H01R 13/62938
USPC ..... 439/372, 352, 304, 595
See application file for complete search history.

(56) References Cited

U.S. PATENT DOCUMENTS 5,722,849 A * 3/1998 Alwine ..... 439/352
5,820,399 A * 10/1998 Shirouzu et al. ..... 439/352
6,004,153 A * 12/1999 Myer et al. ..... 439/352
6,241,547 B1 * 6/2001 Fukuda ..... 439/352
6,537,098 B2 * 3/2003 Kashiyama et al. ..... 439/352
6,666,484 B1 * 12/2003 Branch et al. ..... 292/128
7,204,712 B2 * 4/2007 Schwiebert et al. ..... 439/352
7,396,253 B2 * 7/2008 Nakamura ..... 439/489
7,811,115 B1 * 10/2010 Tyler ..... 439/352
7,988,482 B2 * 8/2011 Kim et al. ..... 439/357
8,083,533 B2 * 12/2011 De Chazal ..... 439/188
2002/0142649 A1 * 10/2002 Baugh et al. ..... 439/532
2011/0286702 A1 * 11/2011 Nielson et al. ..... 385/76
2012/0184122 A1 7/2012 Stokowski et al.
2014/0329400 A1 * 11/2014 Kakizaki et al. ..... 439/304

FOREIGN PATENT DOCUMENTS

JP H10-223312 A 8/1998
KR 10-2011-0080135 A 7/2011
KR 10-2012-0090308 A 8/2012
KR 10-2012-0120810 A 11/2012

* cited by examiner

*Primary Examiner* — Briggitte R Hammond
(74) *Attorney, Agent, or Firm* — Mintz Levin Cohn Ferris Glovsky and Popeo, P.C.; Peter F. Corless

(57) ABSTRACT

A high voltage connector is provided that includes a female body, a male body, and a safety pin. The female body has an insertion bore, a push bar, and an engagement portion. The male body is inserted in the female body. An upper end portion of the male body has an engagement hook positioned to correspond to the engagement portion to engage the engagement hook and the engagement portion when the male body is inserted into the insertion bore of the female body. In addition, a first side of the safety pin is inserted in an upper portion of the insertion bore in the female body and contacts first sides of the engagement portion and the engagement hook. A second side of the safety pin is exposed and has a pin recess into which a removal tool is to be inserted.

10 Claims, 8 Drawing Sheets

HIGH VOLTAGE CONNECTOR

CROSS-REFERENCE TO RELATED APPLICATION

The present application claims priority of Korean Patent Application No. 10-2013-0078868 filed on Jul. 5, 2013, the entire contents of which is incorporated herein for all purposes by this reference.

BACKGROUND

1. Field of the Invention

The present invention relates to a high voltage connector that includes a male body and a female body which are not easily disassembled, when normally combined, without use of a special tool.

2. Description of the Related Art

A conventional high voltage connector includes a male body and a female body. In this conventional high voltage connector, electrodes are disposed between the male body and female body. When the male body is inserted into the female body, thus combining the male body and the female body, a contact is made within the bore assembly. In this high voltage connector, the contact should not be exposed due to safety issues. In addition, it is necessary to prevent the male and female bodies from accidentally separating, for example, by intervention of other parts or assembly errors. Although the high voltage connector needs to be firmly assembled to prevent disassembly, a repair technician should be able to disassemble the structure for repair or replacement of parts when necessary.

The foregoing is intended merely to aid in the understanding of the background of the present invention, and is not intended to mean that the present invention falls within the purview of the related art that is already known to those skilled in the art.

SUMMARY

Accordingly, the present invention provides a high voltage connector that includes a male body and a female body which are not easily disassembled (e.g., prevent separation) when combined, without use of a special tool.

Accordingly to one aspect of the present invention, a high voltage connector may include: a female body having an insertion bore therein, a push bar installed at an upper side of the insertion bore in a hinged manner, and an engagement portion formed at a first side of the push bar; a male body which is inserted into the insertion bore of the female body and provided with an engagement hook positioned to correspond to the engagement portion causing the engagement portion and the engagement hook to come into engagement when the male body is inserted into the insertion bore of the female body; and a safety pin in which a first side of the safety pin is inserted into an upper portion of the insertion bore of the female body and comes into contact with first sides of the engagement portion and the engagement hook to restrict rotation of the push bar, and a second side of the safety pin is exposed and is provided with a pin recess into which a removal tool may be inserted.

A second side of the push bar may be exposed. When the second side is pressed from above and the safety pin is removed, the push bar may rotate and the engagement portion may be separated from the engagement hook. Surfaces of the engagement portion and the engagement hook which are in contact may be inclined surfaces, and thus the engagement hook may press the engagement portion when the male body is inserted into the insertion bore of the female body, thereby lifting the first side of the push bar and causing the engagement hook to move, riding over the engagement portion.

Furthermore, the first side of the push bar may include an aperture and a portion in front of the aperture may operate as the engagement portion and the first side of the safety pin may pass through the aperture of the push bar. The engagement hook may protrude from an upper surface of the male body, and may move over the engagement portion to be positioned in the aperture when the male body is inserted into the insertion bore of the female body.

The first side of the safety pin comes into contact with upper ends of the engagement portion and the engagement hook after passing through the aperture, and an end of the first side of the safety pin may be bent downward in front of the engagement portion and may be shaped to surround the engagement portion and the engagement hook. After the safety pin is inserted, the first side of the safety pin may be positioned at upper ends of the engagement portion and the engagement hook, and the second side of the safety pin may be positioned at a lower end of the second side of the push bar, to fix the push bar.

The pin recess of the safety pin may have a diameter of about 2 mm or less. The second side of the safety pin may have an elongated recess that extends from the pin recess to the second side of the safety pin. In addition, the pin recess of the safety pin may have a bore shape that penetrates and extends through the safety pin, and the elongated recess may have a substantially constant depth while extending from the pin recess to the second side of the safety pin and may extend in a longitudinal direction.

According to an exemplary embodiment, a safety pin may be inserted after a female body and a male body are combined to improve the structural stability of a high voltage connector. Accordingly, the high voltage connector may be prevented from accidentally being disassembled, for example, by intrusion of other parts or a user's finger nail. Additionally, the high voltage connector may have a double lock system allowing the high voltage connector to be disassembled by removing the safety pin using a special tool if necessary.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/of" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinbelow, exemplary embodiments of the present invention will be described in detail with reference to the accompanying drawings.

Figure 1:
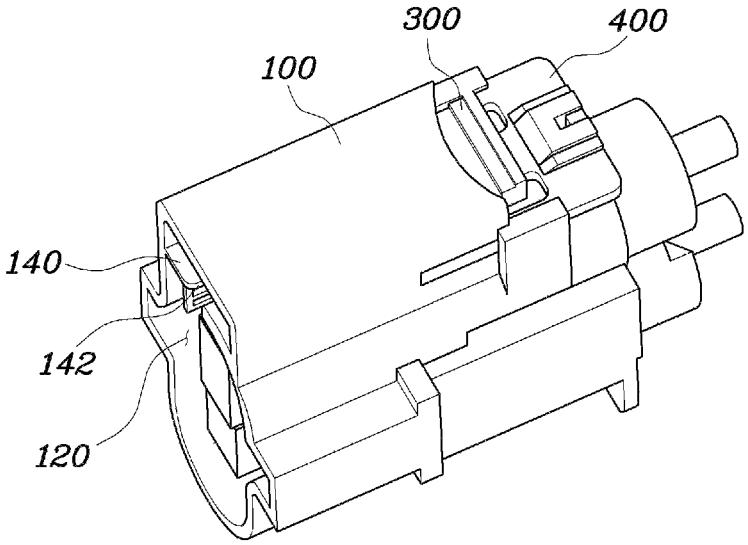
FIG. 1 is an exemplary diagram illustrating a female body of a high voltage connector according to one exemplary embodiment.
Figure 2:
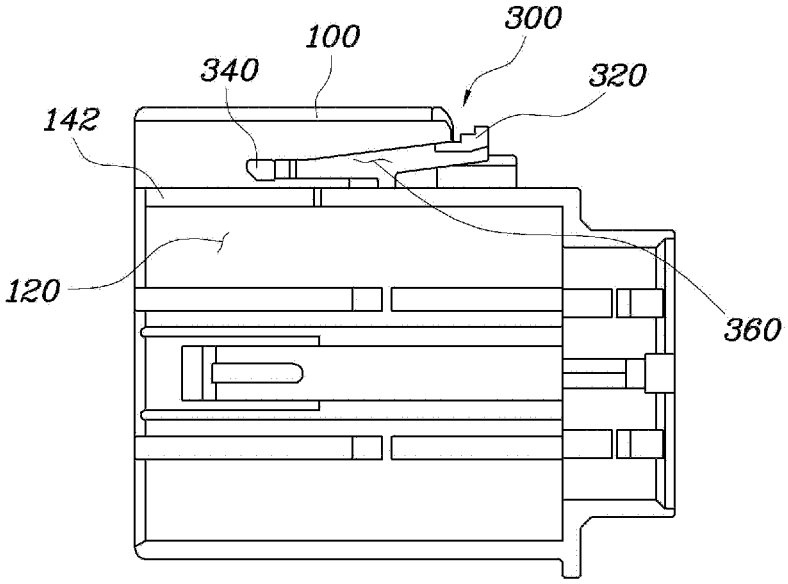
FIG. 2 is an exemplary cross-sectional view of the female body of the high voltage connector according to the exemplary embodiment.
Figure 3:
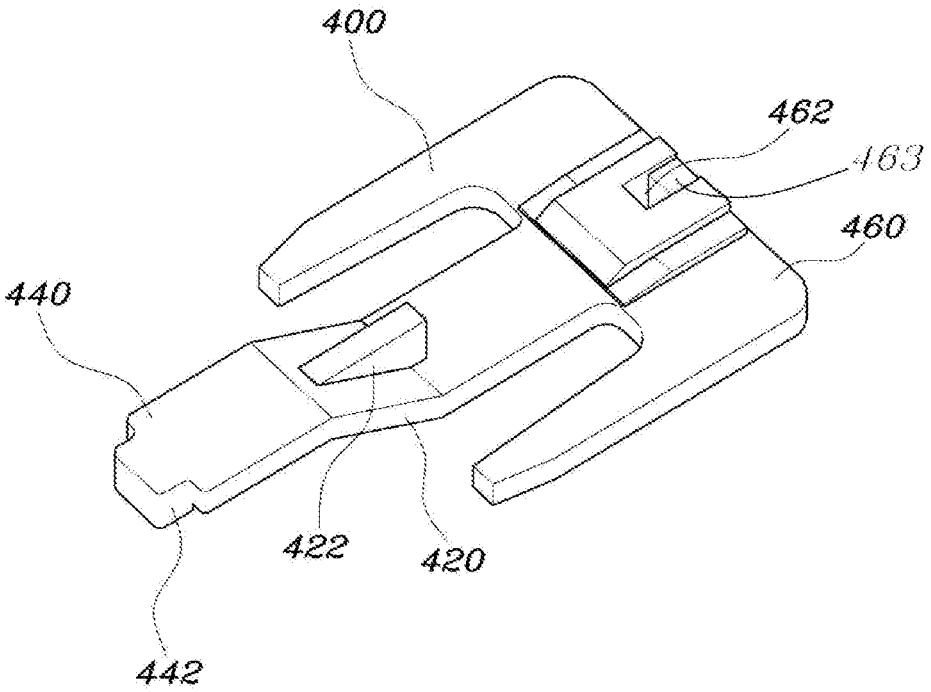
FIG. 3 is an exemplary diagram illustrating a safety pin of the high voltage connector according to the exemplary embodiment.
Figure 4:
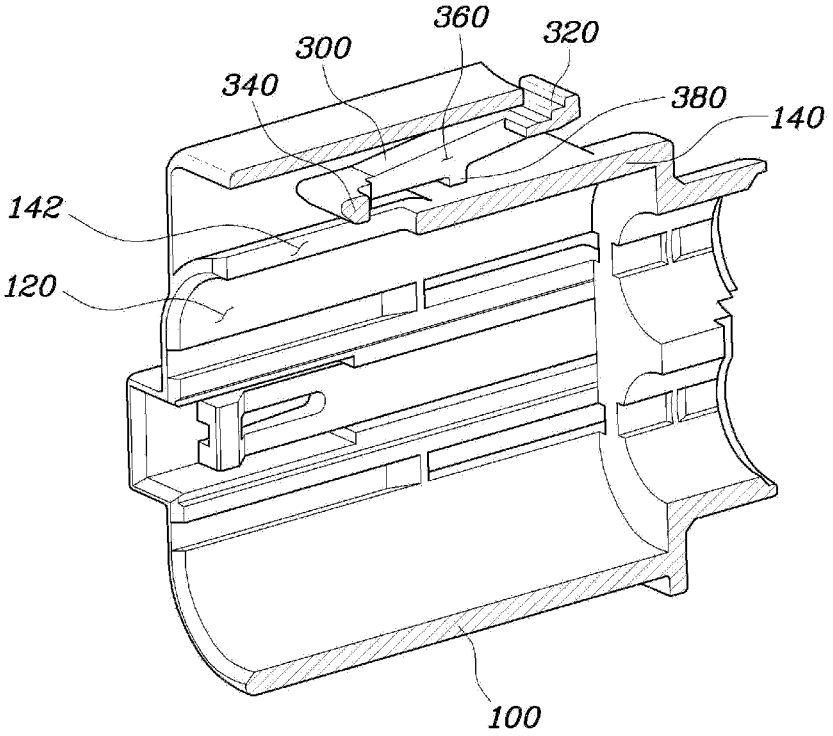
FIG. 4 is an exemplary diagram illustrating a push bar of the high voltage connector according to the exemplary embodiment.

FIG. 1 is an exemplary diagram illustrating a female body of a high voltage connector according to one exemplary embodiment; FIG. 2 is an exemplary cross-sectional view of the female body of the high voltage connector according to the exemplary embodiment; FIG. 3 is an exemplary diagram illustrating a safety pin of the high voltage connector according to the exemplary embodiment; FIG. 4 is an exemplary diagram illustrating a push bar of the high voltage connector according to the exemplary embodiment; and FIGS. 5 to 8 are exemplary cross-sectional views illustrating a procedure of assembling the high voltage connector according to the exemplary embodiment.

The high voltage connector may include a female body, a male body, and a safety pin. The female body may have an insertion bore, a push bar installed at an upper side of the insertion bore in a hinged manner (e.g., via a hinge), and an engagement portion disposed at a first side of the push bar. The male body may be inserted into the insertion bore of the male body and may include an engagement hook at an upper portion thereof. The engagement hook may be positioned to correspond to the engagement portion to engage the engagement hook and the engagement portion when the male and female bodies are combined. In addition, a first side of the safety pin may be inserted in an upper portion of the insertion bore in the female body and a second side of the safety pin may be in contact with first side of the engagement portion and the first side of the engagement hook, to restrict rotation of the push bar. The second side of the safety pin may be exposed and may include a pin recess into which a removal tool may be inserted.

Hereinbelow, an exemplary embodiment will be described in more detail with reference to the accompanying drawings.

As shown in FIG. 1, a female body 100 may include an insertion bore 120 to receive a male body 200 therein. A push bar 300 may be installed at an upper side of the insertion bore 120 in a hinged manner (e.g., via a hinge). In the insertion bore 120, a bather wall 140 may be formed at an upper portion of a principal space of the insertion bore 120 into which the male body 200 may be inserted, allowing a separate space may be provided. A slit 142 may be formed in the bather wall 140 into which an engagement hook 220 of the male body 200 may be inserted and the engagement hook 200 may slide along the slit 142.

The push bar 300 may be connected to the upper surface of the bather wall 140 in a hinged manner via a hinge assembly 380 and may be disposed in an upper portion of the insertion bore 120 divided by the bather wall 140. Further, the push bar 300 may be connected to the female body 100 via the hinge assembly 380. As illustrated in FIGS. 2 and 4, a first end of the push bar 300 disposed inside the female body 100 may include an engagement portion 340, and a second end 320 of the push bar 300 may include a knob pushed by a user. The push bar 300 and the female body 100 may be integrally formed through an injection molding process when connected via the hinge assembly 380. The hinge assembly 380 may be made of plastic and may be configured to connect the push bar 300 to the female body 100 allowing slight rotation of the push bar 300.

Furthermore, the male body 200 may be inserted into the insertion bore 120 of the female body 100, and may include an engagement hook 220 at an upper portion of the male body 200 in a position that corresponds to the engagement portion 340. Therefore, when the male body 200 and the female body 100 are combined, the engagement hook 220 may move over the engagement portion 340. In this way, the male body 200 and the female body 100 may be connected (e.g., locked) by the engagement between the engagement portion 340 and the engagement hook 220. In other words, the engagement hook 220 may slide over and engage with the engagement portion 340.

A first end portion 440 of the safety pin 400 may be inserted in an upper portion of the insertion bore 120 of the female body 100 and the first end portion 440 of the safety pin 400 may come into contact with a first side of the engagement portion 340 and a first side the engagement hook 220, to restrict rotation of the push bar 300. A second end portion 460 of the safety pin 400 may be exposed and may include a removal recess 462 into which a removal tool may be inserted. When the safety pin 400 is inserted into the insertion bore 120, the first end portion 440 may come into contact (e.g., engage, slide together with, etc.) with the first sides of the engagement portion 340 and the engagement hook 220, to restrict the rotation of the push bar 300, thus creating a secondary locking mechanism. The secondary lock may improve coupling between the engagement portion 340 and the engagement hook 220. Since the safety pin 400 may include a pin recess 462 into which the removal tool may be inserted, the safety pin 400 may be prevented from being removed by a user (e.g., a user's nail). In other words, a technician may be able to pull the safety pin 400 out of the assembly of the male body and the female body.

Specifically, the push bar 300 may be installed at an upper portion of the female body 100. When a second end portion 320 of the push bar 300 is exposed to exterior and the second end portion 320 is pressed from above when the safety pin 400 is removed, the push bar 300 may rotate and a first end portion of the push bar 300 may move upward. Thus, the engagement portion 340 may be separated from the engagement hook 220. In addition, surfaces of the engagement portion 340 and the engagement hook 220 which are in contact may be inclined surfaces that conform (e.g., correspond) to each other. Accordingly, when the male body 200 is inserted into the insertion bore of the female body, the engagement hook 220 may press (e.g., apply pressure to) the engagement portion 340 to lift the first end of the push bar 300 and thus the engagement hook 220 may move over the engagement portion 340.

Conversely, when removing the engagement hook 220, the engagement portion 340 may be upward, and primary locking occurs. The first end portion of the push bar 300 may include an aperture 360 and a portion in front of the aperture 360 may operate as the engagement portion 340. The first end portion 440 of the safety pin 400 may be installed to pass through the aperture 360 of the push bar 300. In other words, as illustrated in FIGS. 2 and 4, the push bar 300 may have a substantially rectangular frame shape and the aperture 360 may be formed at the first end portion of the push bar 300. A front end portion that traverses the aperture 360 may operate as the engagement portion 340. With this arrangement, the first end portion 440 of the safety pin 400 may pass through the aperture 360 and may prevent the engagement portion 340 from being lifted up. Therefore, the engagement hook 220 may be automatically hooked to the engagement portion 340 and may not be separated from the engagement portion 340, and thus secondary locking may occur, preventing the male body 200 from being separated from the female body 100 until the safety pin 400 is removed.

On the other hand, the engagement hook 220 may protrude from the upper surface of the male body 200, and the engagement hook 220 may move over the engagement portion 340 to be positioned in the aperture 360 when the male body 200 is inserted into the female body 100. The engagement hook 220 may be hooked to the engagement portion 340 to prevent the engagement hook 220 from being separated from the engagement portion 340. The first end portion 440 of the safety pin 400 may pass through the aperture 360 and may contact upper ends of the engagement portion 340 and the engagement hook 220. A front end 442 of the first end portion 440 may be bent downward in front of the engagement portion 340 and thus may be shaped to surround the engagement portion 340 and the engagement hook 220.

In other words as illustrated in FIG. 3, the front end 442 of the first end portion 440 of the safety pin 400 may be bent downward to be shaped to surround the engagement portion 340 and the engagement hook 220 when the engagement portion 340 and the engagement hook 220 are engaged. Accordingly, rising of the engagement portion 340 may be prevented inside the female body 100 to prevent the removal of the engagement hook 220 and the male body 200.

When the safety pin 400 is inserted into the insertion bore 120, the first end portion 440 may be positioned at the upper ends of the engagement portion 340 and the engagement hook 220, and the second end portion 460 may be positioned at a lower end of the second side 320 of the push bar 300, to fix the push bar 300. A middle portion 420 of the safety pin 400 may have a protrusion 442 that protrudes upward (e.g., vertically). When the safety pin 400 is pressed in a direction in which the safety pin is removed, the protrusion 422 may be engaged with the second end 320 of the push bar 300 and thus the safety pin 400 may not be completely pulled out. The safety pin 400 may be pulled back by a pulling force when a user pulls the safety pin 400 using a specific removal tool. However, without a sufficiently strong force, the protrusion 422 may remain restricted by the second end portion 320 of the push bar 300 to prevent the safety pin 400 from being completely pulled out.

Furthermore, the safety pin 400 and the push bar 300 may be made of plastic material to be substantially deformed. In addition, the pin recess 462 of the safety pin 400 may have a diameter of about 2 mm or less. Accordingly, the safety pin 400 may not be easily removed by accident. In other words, the male body 200 and the female body 100 may not be separated without using a specific removal tool. The removal tool may have a substantially sharp end to be inserted into a substantially small bore, for example, having a size of about 2 mm. Examples of the removal tool may include an awl, a wire, a pen, a knife, and the like.

The second end portion 460 of the safety pin 400 may include an elongated recess 463 that extends from the pin recess 462 to the second end portion 460 of the safety pin 400. In other words, as illustrated in FIG. 3, the pin recess 462 of the safety pin 400 may have a bore shape that penetrates and extends through the safety pin 400, and the elongated recess 463 may have a substantially constant depth from the pin recess to the second end of the safety pin and extend in a longitudinal direction. Therefore, even though, for example, a user's finger nail (e.g., or a substantially thin object) may be inserted into the pin recess 462, the object may not extend into the pin recess due to the elongated recess 463.

FIGS. 5 to 8 are exemplary cross-sectional views illustrating the procedure of assembling the high voltage connector according to the exemplary embodiment, and the procedure will be described below.

Figure 5:
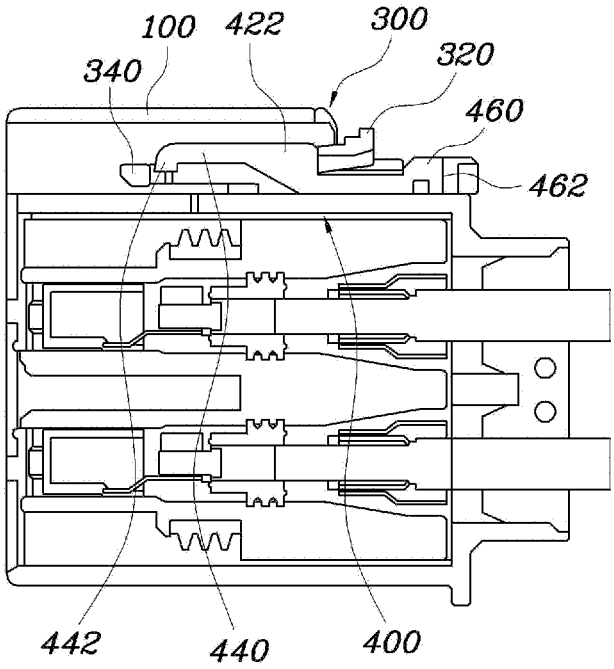
FIGS. 5 to 8 are exemplary cross-sectional views illustrating a procedure of assembling the high voltage connector according to the exemplary embodiment.
Figure 6:
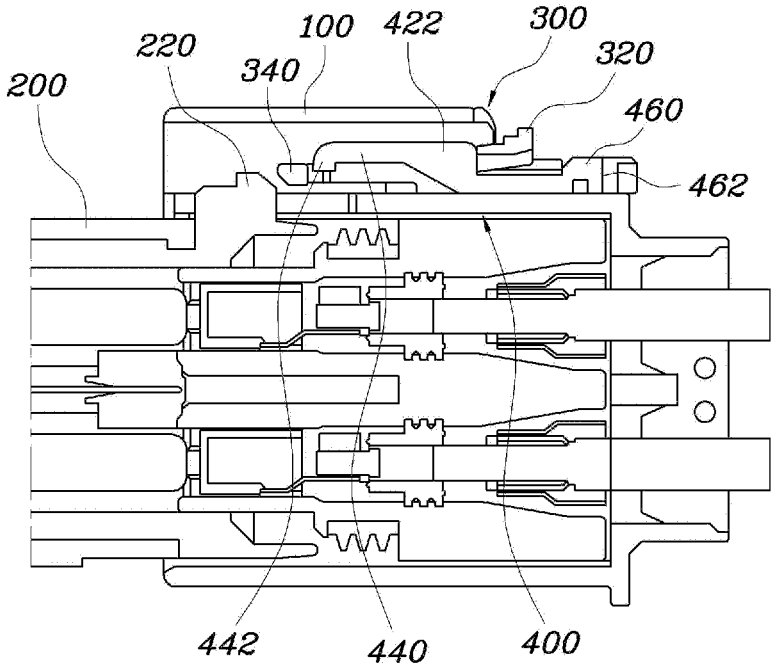
Figure 7:
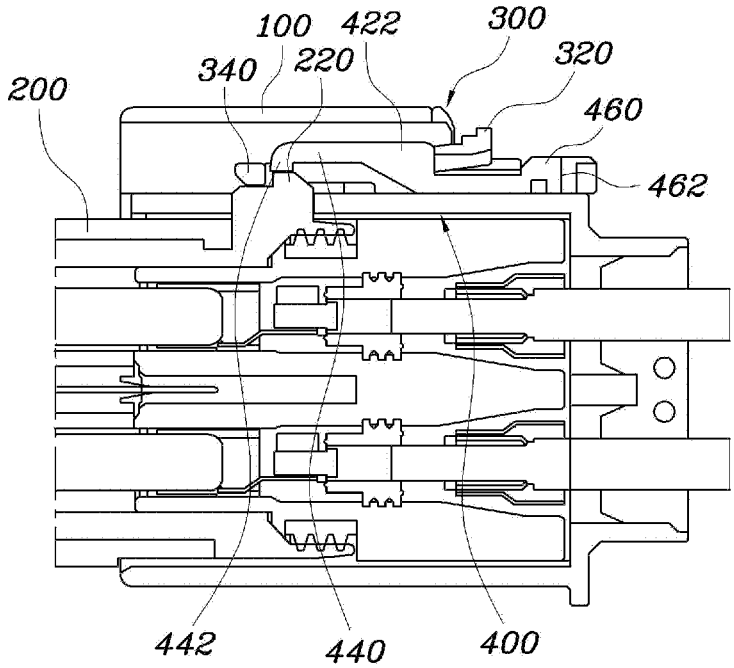
Figure 8:
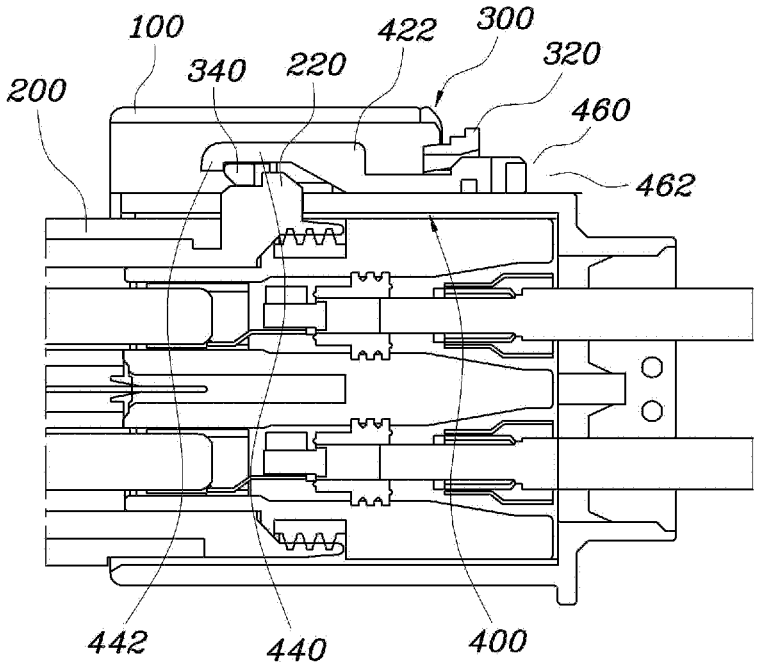

First, as illustrated in FIG. 5, the safety pin 400 may be partially pulled out (e.g., removed) and the engagement portion 340 of the push bar 300 may be positioned in front of the front end 442 of the safety pin 400. The push bar 300 may then be slightly rotated. When the male body 200 is inserted as illustrated in FIG. 6, the engagement hook 220 may press the engagement portion 340 of the push bar 300 upward (e.g., vertically), and then may move over the engagement portion 340 as illustrated in FIG. 7 when further inserted. The engagement hook 220 may be positioned in a back of the engagement portion 340 to form a first locking mechanism.

When the second end portion 320 of the push bar 300 is pressed, the male body 200 may be easily removed. However, as illustrated in FIG. 7, as the safety pin 400 is inserted to advance forward, the end 442 of the safety pin 400 may be positioned at the most leading end, and movement of the upper and front ends of the engagement portion 340 and the engagement hook 220 may be restricted by the first end portion 440 of the safety pin 400. Accordingly, even though the second end portion 320 of the push bar 300 may be pushed, since the rotation of the push bar 300 is restricted, the engagement hook 220 may not be completely removed. Furthermore, as the bent end 442 of the safety pin 400 is engaged with the engaging portion 340 and is thus not easily separated, the combined state of the male body 200 and the female body 100 may be maintained.

The procedure of disassembling is the reverse of procedure illustrated in FIGS. 5 through 8. That is, a special removal tool may be inserted into the pin recess 462 of the safety pin 400 to pull back the safety pin 400. After that, the second end portion 320 of the push bar 300 may be pressed to lift the engagement portion 340, and thus the male body 200 may be removed.

According to the exemplary embodiment, structural stability of the high voltage connector may be improved by the safety pin inserted after the female body and the male body are engaged. Accordingly, the high voltage connector may be prevented from accidentally being dissembled by, for example, intrusion of other parts or a user's finger nail. In addition, the high voltage connector may have a double lock structure to allow the high voltage connector to be disassembled by removing the safety pin using a special tool if necessary.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A high voltage connector comprising:

a female body that includes an insertion bore, a push bar installed to an upper portion of the female body via a hinge, and an engagement portion disposed at a first side of the push bar;

a male body inserted in the insertion bore of the female body and that includes an engagement hook positioned to correspond to the engagement portion; and a safety pin in which a first side of the safety pin is inserted in an upper portion of the insertion bore to contact a first side of the engagement portion and a first side of the engagement hook to restrict rotation of the push bar, and a second side of the safety pin is exposed and includes a pin recess into which a removal tool is inserted.

2. The high voltage connector according to claim 1, wherein a second side of the push bar is exposed, and wherein the push bar rotates and the engagement portion is separated from the engagement hook when the second side of the push bar is pressed from above as the safety pin is removed.

3. The high voltage connector according to claim 1, wherein surfaces of the engagement portion and the engagement hook which are in contact are inclined surfaces, wherein the engagement hook presses the engagement portion when the male body is inserted into the insertion bore of the female body to lift the first side of the push bar, and the engagement hook moves over the engagement portion to engage with the engagement portion.

4. The high voltage connector according to claim 1, wherein the first side of the push bar includes an aperture, wherein a portion in front of the aperture operates as the engagement portion, and wherein the first side of the safety pin passes through the aperture of the push bar.

5. The high voltage connector according to claim 4, wherein the engagement hook protrudes from an upper surface of the male body, and moves over the engagement portion to be positioned in the aperture when the male body is inserted into the insertion bore of the female body.

6. The high voltage connector according to claim 4, wherein the first side of the safety pin comes into contact with upper ends of the engagement portion and the engagement hook after passing through the aperture, and an end of the safety pin is bent downward in front of the engagement portion and is shaped to surround the engagement portion and the engagement hook.

7. The high voltage connector according to claim 1, wherein after the safety pin is inserted in the insertion bore, the first side of the safety pin is positioned at upper ends of the engagement portion and the engagement hook and the second side of the safety pin is positioned at a lower end of a second side of the push bar to fix the push bar.

8. The high voltage connector according to claim 1, wherein the pin recess of the safety pin has a diameter of about 2 mm or less.

9. The high voltage connector according to claim 1, wherein the second side of the safety pin includes an elongated recess that extends from the pin recess to the second side of the safety pin.

10. The high voltage connector according to claim 9, wherein the pin recess of the safety pin has a bore shape that penetrates and extends through the safety pin, and the elongated recess is recessed to have a substantially constant depth from the pin recess to the second side of the safety pin and to extend in a longitudinal direction.

* * * * *